United States Patent [19]

Birmingham

[11] 4,256,287

[45] Mar. 17, 1981

[54] HANDRAIL AND METHOD OF MAKING THE SAME

[75] Inventor: Robert A. Birmingham, Memphis, Tenn.

[73] Assignee: Owen Lumber & Millwork, Inc., Memphis, Tenn.

[21] Appl. No.: 15,299

[22] Filed: Feb. 26, 1979

[51] Int. Cl.[3] ..... E04H 17/14

[52] U.S. Cl. ..... 256/59; 52/731; 144/309 J

[58] Field of Search ..... 52/731, 727; 256/59, 256/19; 144/309 R, 309 J, 309 K, 309 L, 315 R, 315 A; 138/157, 159

[56] References Cited

U.S. PATENT DOCUMENTS

| | | | |
|---|---|---|---|
| 163,996 | 6/1875 | Hardy | 52/731 |
| 839,189 | 12/1906 | Oberbeck | 52/727 X |
| 902,631 | 11/1908 | Wentworth | 52/731 |
| 3,077,012 | 2/1963 | Speraw | 52/727 X |
| 3,106,752 | 10/1963 | Hannen | 52/731 |
| 3,168,170 | 2/1965 | Thom | 52/731 X |

FOREIGN PATENT DOCUMENTS

| | | | |
|---|---|---|---|
| 504115 | 4/1920 | France | 256/59 |
| 236718 | 7/1945 | Switzerland | 52/731 |
| 348366 | 5/1931 | United Kingdom | 52/727 |

*Primary Examiner*—Andrew V. Kundrat

*Attorney, Agent, or Firm*—Gravely, Lieder & Woodruff

[57] ABSTRACT

A handrail has a hollow core that is fabricated from joined together segments of relatively inexpensive material. A laminating material adheres to and covers the core, providing an attractive, durable gripping surface for the handrail.

16 Claims, 3 Drawing Figures

FIG. 1
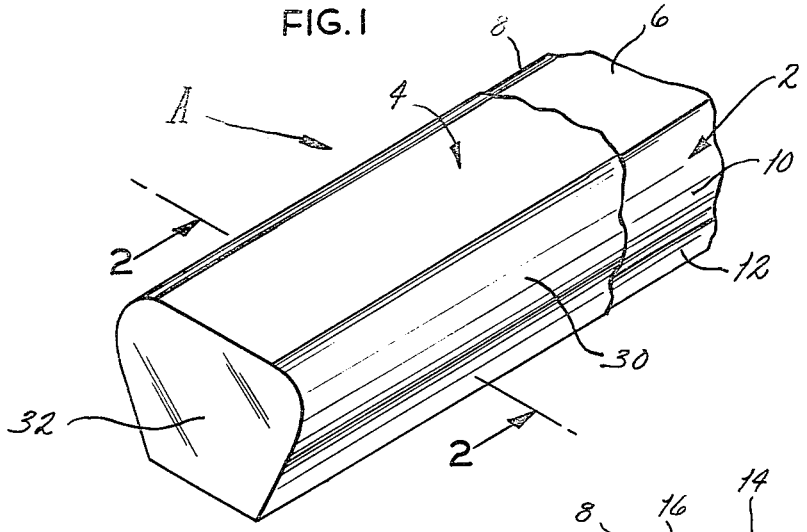
FIG. 2
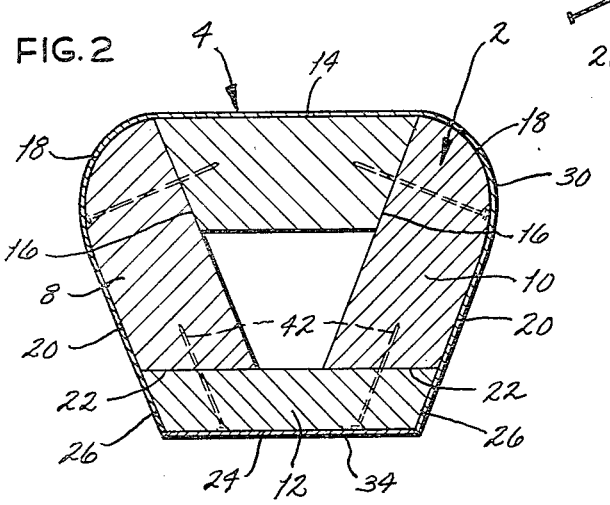
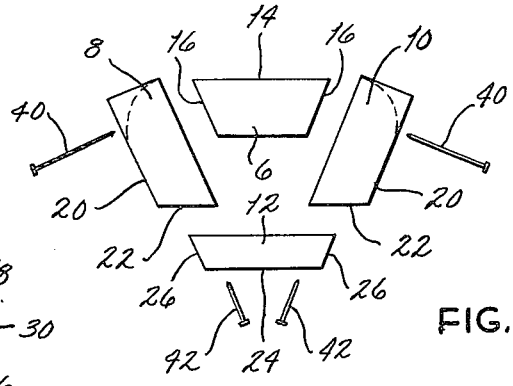
FIG. 3
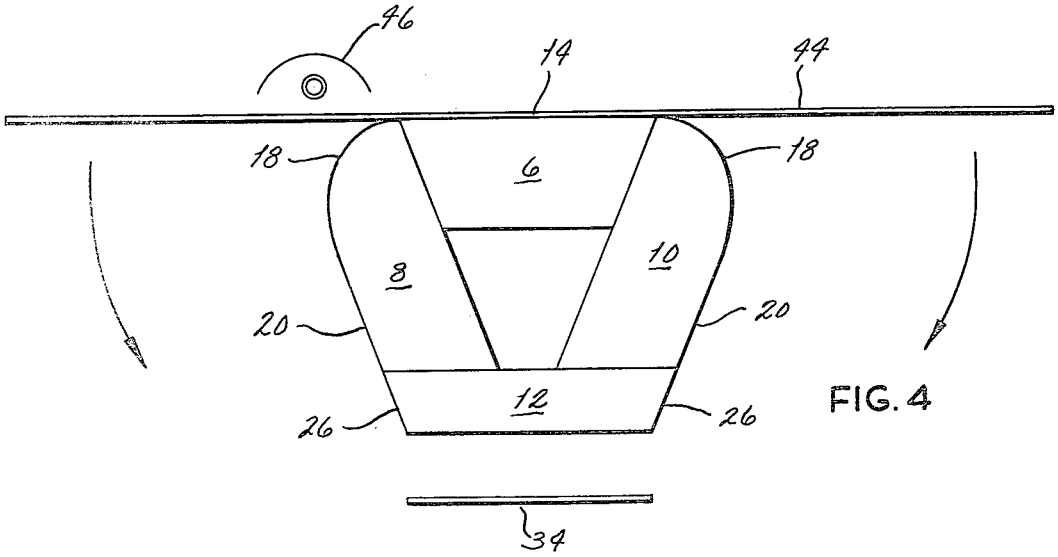
FIG. 4

HANDRAIL AND METHOD OF MAKING THE SAME

BACKGROUND OF THE INVENTION

This invention relates in general to simulated millwork and, more particularly, to handrails and the like.

Out of concern for safety and to comply with recent governmental regulations, handrails are now being installed in many locations where they were rarely found only several years ago. For example it is now a common practice to run handrail along the hallways of hospitals, nursing homes, and residences for the elderly, whereas before handrails were only found at the stairways in these buildings.

Wood is perhaps the most common material used in handrails, but in recent years wood millwork has undergone a tremendous increase in price. This is particularly true of handrails formed from oak. On the other hand, handrails made from some of the finer wods such as walnut and teak are practically unavailable. Metal handrails, at least in sizes large enough to conveniently grip are also quite expensive.

Even where wood is available, it is not ideally suited for use in the handrails of some buildings such as hospitals, since wood is porous and will therefore retain microorganisms more readily than other materials, or at least it cannot be washed with disinfectants as easily as other less porous materials. Furthermore, most wood handrails are supplied in an unfinished condition and are usually stained and varnished after they are installed. The finish in time wears off, and therefore handrails must be varnished at periodic intervals.

SUMMARY OF THE INVENTION

One of the principal objects of the present invention is to provide a handrail that is clad with a material which is easily cleaned and extremely durable, yet is attractive in appearance. Another object is to provide a handrail of the type stated that need not be finished with paint or varnish once it is installed, nor need it be refinished at periodic intervals. Still another object is to provide a handrail of the type stated which can be fabricated from inexpensive, yet dimensionally stable materials such as particleboard and plastic laminating material. An additional object is to provide a handrail that is ideally suited for use in hospitals, residences for the elderly, and the like. Yet another object is to provide a method of fabricating a handrail of the type stated. These and other objects and advantages will become apparent hereinafter.

The present invention is embodied in a handrail comprising a segmented core and a laminating material attached to and extended over the core. It is also embodied in a process including fabricating a core from strips of generally rigid material and applying the laminating material to the core. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur:

FIG. 1 is a perspective view of a handrail constructed in accordance with the present invention;

FIG. 2 is a sectional view of the handrail taken along line 2—2 of FIG. 1;

FIG. 3 is an exploded sectional view of the strips from which the core of the handrail is fabricated; and FIG. 4 is a sectional view of the core showing the gripping portion of the covering being applied to it.

DETAILED DESCRIPTION

Referring now to the drawings (FIG. 1), A designates a handrail that simulates expensive millwork, yet is fabricated from materials that are relatively inexpensive, extremely durable, and easy to maintain. The handrail A includes (FIGS. 1 & 2) a hollow segmented core 2 and a hard scratch-resistant covering 4 extended over the core 2. The covering 4 enhances the appearance of the handrail A and may be any of a wide variety of plastic laminating materials currently available. It is also extremely durable and easy to clean.

The segmented core 2 consists of (FIGS. 1–3) four strips which are joined together in a somewhat trapezoidal configuration having a hollow center. More specifically, the core 4 consists of a top strip 6, left and right side strips 8 and 10, and a bottom strip 12. The four strips 6, 8, 10 and 12 may be any material that is easily worked, such as lumber and particleboard, with the latter being preferred due to its cost and dimensional stability. Indeed, $\frac{3}{4}$ inch thick (actual thickness) particleboard having 45 lb. density is ideally suited for the top strip 6 and side strips 8 and 10, while $\frac{3}{8}$ or $\frac{3}{4}$ inch thick (actual dimension) particleboard of the same density is suitable for the bottom strip 12.

The top strip 6 has a flat upper surface 14 (FIG. 2) and beveled side surfaces 16 that converge downwardly. The two side strips 8 and 10 are joined, preferably by both glue and nails, to the beveled side surfaces 16 of the top strip 6. The side strips 8 and 10 extend all the way up to the flat upper surface 14 of the top strip 6, and beyond the ends of the top strip 6, the side strips 8 and 10 are rounded off to provide arcuate corners 18 that blend into flat side faces 20 on the side strips 8 and 10. The radius of the corners 18 should range between $\frac{5}{8}$ and $\frac{7}{8}$ inches. The side faces 20 of the two strips 8 and 10 converge downwardly, providing sloping sides to the handrail A. The included angle between each side face 20 and the upper surface 14 of the top strip 6 should range between 25° and 35° and should preferably be 30°.

The two side strips 8 and 10 project downwardly from the top strip 6, and terminate at flat bottom surfaces 22 (FIG. 2) which are coplanar and parallel to the upper surface 14 of the top strip 6. The bottom strip 12 is joined, preferably by glue and nails, to the flat bottom surfaces 22 of the two side strips 8 and 10. It has a flat lower surface 24 that is parallel to the upper surface 14 on the top strip 6. Along its sides, the bottom strip 6 has beveled faces 26 which are inclined at the same angle as the side faces 20 on the side strips 8 and 10 and furthermore lie flush with the side faces 20.

The four strips 6, 8, 10 and 12 when joined together form a rigid structure of polygonal, or more specifically trapezoidal, cross-sectional configuration, and that structure is, of course, the segmented core 2. Being hollow, the core 2 is relatively light in weight, considering the density of the particleboard or other material from which it is fabricated.

The covering 4 is preferably a plastic laminating material such as that sold under the trademark Formica. It includes a gripping portion 30 (FIGS. 1 & 2) that extends the entire length of the handrail A, covering the top strip 6 as well as the two side strips 8 and 10 and the beveled faces 26 on the bottom strip 12. More specifically, the gripping portion 30 adheres to the upper surface 14 on the top strip 6 and at the sides of the top strip 6, it wraps around the arcuate corners 18 on the side strips 8 and 10, its lateral areas being adhered to the corners 18 and to the flat side faces 20 of the side strips 8 and 10. Aside from the gripping portion 30, the covering 4 also includes two end caps 32 (FIG. 1) that cover the ends of the core 2 and thereby obscure its hollow interior. In this regard, the end faces of the four strips 6, 8, 10 and 12 are planar and flush, and the end caps 32 adhere to these end faces. Completing the covering 4 is an underlying portion 34 (FIG. 2) which adheres to the flat bottom surface 22 of the bottom strip 12, completely covering that surface.

The gripping portion 30 and the two end caps 32 should have an attractive appearance inasmuch as they are exposed to those who pass along the handrail A. Standard 1/16 inch forming grade plastic laminating material is suitable for the gripping portion 30 and for the end caps 32 as well. This material may have a grain in it to give the handrail A the appearance of natural wood. Since the underlying portion 34 is not usually visible, it may be formed from backing grade plastic laminating material, or may be eliminated altogether in some applications.

The handrail A is attached to a wall in the usual manner, that is with brackets that are connected to the handrail with screws threaded into the bottom wall 12.

To fabricate the handrail A, the four strips 6, 8, 10 and 12 are first cut from a suitable material, preferably particleboard (FIG. 3). This involves nothing more than making rip cuts through particleboard sheet of sufficient length. Since all four of the strips 6, 8, 10, and 12 have beveled surfaces, most of the rip cuts are made with the saw blade set at an angle to its table, and that angle is the same for all of the beveled cuts. However, the edges of the side strips 8 and 10 along which the arcuate corners 18 are formed may be cut with the saw blade perpendicular to its table.

Once the strips 6, 8, 10 and 12 are ripped from the particleboard sheet, they are joined together by glue and nails to produce the trapezoidal configuration. In particular, a line of glue is first applied to the left beveled surface 16 of the top strip 6 and then the side strip 8 is fitted against that surface and secured to it with nails 40 which are driven completely through the strip 8 and into the top strip 6. The nails 40 enter the side strip 8 close to the line of tangency between the flat side face 20 and the subsequently formed arcuate corner 18. Moreover, the force with which the nails 40 are driven is sufficient to set the heads of nails 40 about 1/16 inches below the surface of the strip 8. The right strip 10 is joined to the right beveled surface 16 of the top strip 6 in the same menner, care being exercised to insure that its bottom surface 22 is coplanar with that of the bottom surface on the strip 8. Then the connected strips 6, 8, and 10 are turned over so that the bottom coplanar surfaces 22 of the two side strips 8 and 10 face upwardly. Next the glue lines are run along the surfaces 22 and the bottom strip 12 is fitted over them such that it spans the short space between them. The bottom strip 12 is secured with nails 42 which are driven through it and into the side strips 8 and 10. When the glue sets, the polygonal structure that is so formed becomes very rigid.

Once the glue sets, the arcuate corners 18 are machined into the uper edges of the two side strips 8 and 10. This step may be performed on a spindle shaper. Since the heads of the nails 40 are set into the strips 8 and 10 near the lines of tangency for the arcuate corners, the nails 40 do not interfere with cutting tool. Even if the cutting tool contacts the nails 40, little if any damage is inflicted because the nails 40 are quite small, being brads more than conventional nails. This completes the core 42.

To install the covering 4 over the core 2, plastic laminating material is first cut to provide the underlying portion 34. Glue is then applied to the back face of the underlying portion 34 and to the flat lower surface 24 of the bottom strip 12 and the underlying portion 34 is pressed against the surface 24. The edges of the portion 34 are then trimmed, such as with a router, to make them flush with flat side faces 20 of the two side strips 8 and 10.

Next, plastic laminating material is cut to provide a flat sheet 44 that is wide enough to form the gripping portion 30. Then glue is applied to the back face of the flat sheet 44 as well as to the upper surface 14 of the top strip 6 and to the arcuate corners 18 and flat side faces 20 of the left and right side strips 8 and 10. Next, the flat sheet 44 and upper surface 14 are brought together with the top strip 6 centered with respect to the flat sheet 44. Thereafter, the core 4 and partially attached sheet 44 of laminating material are positioned along a heating device 46 that is at least as long as sheet 44 and is capable of concentrating the heat emitted by it in a narrow band. Furthermore, the heating device 46 must have the capability of raising the temperature of the flat sheet 44 high enough to render the laminating material pliable, and with most of the conventional plastic laminating materials this is about 325° F. A chomalox heater, which is a tubular member containing a resistance type heating element, is suitable for this purpose. In any event, that area of the flat sheet 44 which is to be bent around the corner 18 of the side strip 8 on the core 4 is placed along the elongated heating device 46 and heated sufficiently to render it pliable. The left side of the sheet 44 is then bent around the arcuate corner 18 and brought against the flat side face 20 of the left side strip 8. In so doing the glue adheres the sheet 44 to the arcuate corner 18 and to the flat side surface 20.

The right side of the flat sheet 44 of laminating material is bent around the arcuate corner 18 of the right side strip 10 and adhered to the arcuate corner 18 and flat side surface 20 of the strip 10 in the same manner, thus completing the installation of the gripping portion 30 for the cover 4. Should the edges of the gripping portion 30 project beyond the underlying portion 34 on the bottom strip 12 of the core 2, they may at this point be trimmed with a router to bring them flush with the downwardly presented surface on the underlying portion 34. The ends of the gripping portion 30 are trimmed in a similar manner to make them flush with the end faces of the core 4.

Finally, the end caps 32 are applied to the planar end faces of the core 4 with glue. If necessary, the end caps 32 are trimmed along their edges with a router to make those edges flush with the exterior surface of the gripping portion 30 and underlying portion 34.

This invention is intended to cover all changes and modifications of the example of the invention herein chosen for purposes of the disclosure which do not constitute departures from the spirit and scope of the invention.

What is claimed is:

1. A handrail or similar device comprising: a core formed from segments of relatively rigid material joined together into a configuration capable of being easily gripped, and including an upper horizontal member, a lower horizontal member of trapezoidal cross-section, and two side members extending between and being attached to the upper and lower members such that the bottom surfaces of the side members are joined to the top surface of the lower horizontal member with the outer surfaces of the side members being flush with the side surfaces of the lower horizontal member; and a covering of laminating material attached to and extended over at least a portion of the core.

2. The handrail of claim 1 wherein upper horizontal member is of trapezoidal cross-section, and side surfaces of upper horizontal member are joined to inner surfaces of said side members so that top surface of the upper horizontal member is flush with top surfaces of said side members.

3. The handrail of claim 1 wherein the side members have arcuate upper corners.

4. The handrail of claim 3 wherein laminating material is attached to the top surface of upper horizontal member and to the arcuate corners and outwardly presented side surfaces of the side members.

5. The handrail according to claim 1 wherein the core is hollow.

6. A method of fabricating a handrail or similar device, said method comprising: joining strips of relatively rigid material into a core that possesses a configuration convenient for gripping, there being spaced apart top and bottom strips and spaced apart side strips, with each side strip being joined to both the top strip and to the bottom strip such that the center of the core is hollow, the core further having upwardly presented corners which are arcuate; adhering a smooth laminating material to the outwardly presented surface of the top strip; heating the laminating material in the area opposite the arcuate corners on the core with the heating being sufficient to render the laminating material pliable in that area; bending the laminating material around the arcuate corners; and adhering the laminating material to the outwardly presented surfaces for the side strips of the core.

7. The handrail according to claim 6 wherein the core comprises top and bottom strips which are spaced apart and parallel and side strips which extend between and are connected to the top and bottom strips, the side strips being spaced apart and converging downwardly.

8. The method according to claim 6 and further comprising applying another laminating material to the bottom strip of the core.

9. A method of fabricating a handrail, said method comprising: joining strips of generally rigid material together to provide a core having a hollow interior and outwardly presented surfaces arranged in a generally polygonal configuration; machining at least one of the strips such that at least two adjacent surfaces of the polygonal configuration merge at an arcuate corner; applying a smooth laminating material over and adhering it to one of said adjacent surfaces such that the laminating material projects outwardly over the corner; heating the laminating material in the region of the corner sufficiently to render it pliable; bending the laminating material around the arcuate corner such that it conforms to the contour of the corner; and adhering the laminating material to the other of the adjacent surfaces.

10. A method according to claim 9 wherein said one adjacent surface is a top surface that is presented upwardly and said other of the adjacent surfaces is a side surface that is located along one side of the top surface and is presented laterally; wherein another side surface is located adjacent to the other side of the top surface; wherein the strips of the core are machined such that the top surface merges with both side surfaces at arcuate corners; wherein the laminating material is initially adhered to the top surface and projects beyond both arcuate corners; wherein the laminating material is heated in the region of both corners to render it pliable in those regions; wherein the laminating material is bent around both arcuate corners; and wherein the laminating material is adhered to both side surfaces.

11. The method according to claim 10 wherein the polygonal configuration of the core also includes a bottom surface and the side surfaces converge downwardly toward the bottom surface.

12. The method according to claim 11 and further comprising applying an additional smooth laminating material over and adhering it to the bottom surface of the core.

13. A handrail or similar device comprising: a core formed from segments of relatively rigid material joined together into a configuration capable of being easily gripped, and including an upper horizontal member of trapezoidal cross-section, a lower horizontal member, and two side members extending between and being attached to the upper and lower members such that the inner surfaces of the side members are joined to the side surfaces of upper horizontal member with the top surface of the upper horizontal member being flush with top surfaces of said side members, and such that the bottom surfaces of the side members are joined to the top surface of the lower horizontal member with the outer surfaces of the side members being flush with the side surfaces of the lower horizontal member; and a covering of laminating material attached to and extended over at least a portion of the core.

14. A handrail comprising: a core having a top surface, two side surfaces, and a bottom surface all arranged in a generally polygonal configuration with the two side surfaces merging into the top surface at arcuate corners and the bottom surface extending between the two side surfaces, the core being formed from spaced apart top and bottom strips and spaced apart side strips, with the side strips being extended between and joined to the top and bottom strips such that the core has a hollow interior, the top strip having the top surface thereon, the two side strips having side surfaces thereon, and the bottom strip having the bottom surface thereon; a unitary cover of laminating material attached to and covering the top and side surfaces as well as the arcuate corners with the cover bending around and conforming to the contours of the corners; and an additional cover of laminating material attached to and covering the bottom surface, the outwardly presented surface on the additional cover being flush with the lower edges of the unitary cover that is attached to the top and side surface.

15. A handrail according to claim 14 wherein the side surfaces downwardly converge.

16. A handrail according to claim 14 wherein the side strips extend upwardly along the sides of the top strip and the arcuate corners are on side strips.

* * * * *